United States Patent [19]

Petrosky

[11] Patent Number: 5,071,358

[45] Date of Patent: Dec. 10, 1991

[54] ADAPTER LOCKING CLIP

[75] Inventor: Richard A. Petrosky, Warren, Ohio

[73] Assignee: General Motors Corporation, Detroit, Mich.

[21] Appl. No.: 602,594

[22] Filed: Oct. 24, 1990

[51] Int. Cl.[5] ..... H01R 9/09

[52] U.S. Cl. ..... 439/77

[58] Field of Search ..... 439/67, 77, 329, 492, 439/493, 495, 567

[56] References Cited

U.S. PATENT DOCUMENTS

| | | | |
|---|---|---|---|
| 3,417,362 | 12/1968 | Reynolds | 439/77 |
| 4,029,374 | 6/1977 | Nestor | 439/77 |
| 4,474,420 | 10/1984 | Nestor | 439/77 |

OTHER PUBLICATIONS

VDO Instruments Inc. drawing AAK 002 088, dated 2-2-88.

*Primary Examiner*—Neil Abrams

*Attorney, Agent, or Firm*—Francis J. Fodale

[57] ABSTRACT

An adapter locking clip for converting an electrical connector having pull-to-seal panel mounting means to a push-to-seat or plug-in type electrical connector comprises a base having a clasp at each end for embracing respective flexible latch arms at opposite sides of the electrical connector and fastening the locking clip to the electrical connector including lock bars disposed and configured to fit between respective lock shoulders of the flexible latch arms and a flange of the electrical connector, and a plurality of longitudinal appendages that have barbs disposed forwardly of the lock bars and the flange of the electrical connector to engage the back side of a support panel when the electrical connector is plugged into the support panel.

13 Claims, 2 Drawing Sheets

ADAPTER LOCKING CLIP

BACKGROUND OF THE INVENTION

This invention relates generally to electrical connectors having panel mounting means and more specifically to an adapter locking clip for converting electrical connectors having panel mounting means of the pull-to-seat type to a push-to-seat or plug-in type electrical connector.

In a known electrical connector system, a wiring harness is connected to a flexible printed circuit by an electrical connector of the pull-to-seat type at the end of the wiring harness as shown in U.S. Pat. No. 4,474,420 granted to Charles R. Nestor Oct. 2, 1984 and assigned to the assignee of this invention. This known electrical connector has a flange and flexible lock arms by means of which the electrical connector is firmly mounted on an auxiliary panel by fishing the electrical connector through a slot of the auxiliary panel then pulling the electrical connector back through the slot. This sub-assembly is then plugged into to a main panel supporting the flexible printed circuit after which the auxiliary panel may be fastened to the main panel. When so mounted, terminals of the electrical connector engage conductor strips of the flexible printed circuit to electrically connect the wiring harness to the flexible printed circuit.

SUMMARY OF THE INVENTION

The object of this invention is to provide an adapter locking clip that converts an electrical connector having panel mounting means of the pull-to-seat type to a push-to-seat or plug-in type so that the electrical connector can be plugged directly into the panel supporting the flexible printed circuit thereby eliminating the need for an auxiliary panel and the tedious pull-to-seat assembly of the electrical connector to the auxiliary panel.

A feature of the invention is that the adapter locking clip is easily attached to an electrical connector of the pull-to-seat type using its existing panel mounting features.

Another feature of the invention is that the adapter locking clip is attached to an electrical connector of the pull-to-seat type simply by pushing the adapter locking clip onto the cable end of the connector.

Another feature of the invention is that the adapter locking clip has lock bars which cooperate with the existing panel mounting features of the electrical connector in the same way as a support panel thereby facilitating and simplifying the procedure for attaching the adapter locking clip to the electrical connector.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
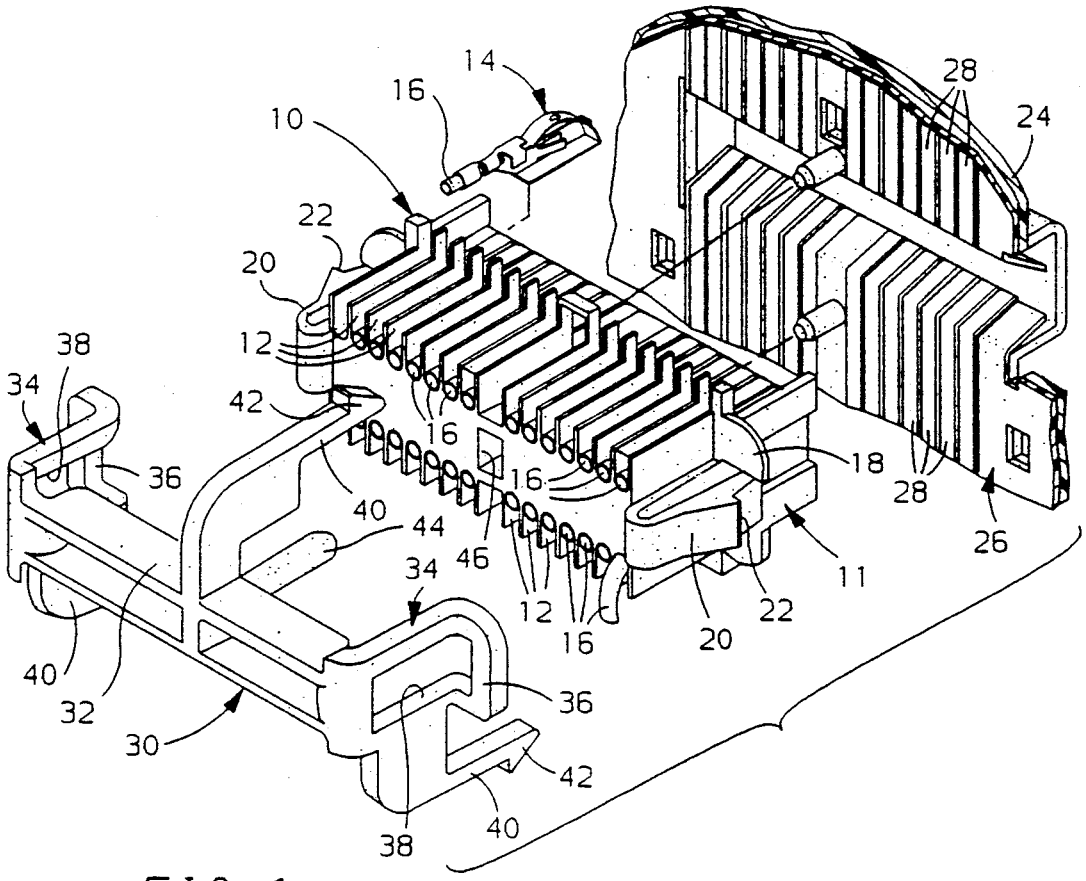
FIG. 1 is an exploded perspective view of an electrical connector system for attaching a wiring harness to a flexible printed circuit that includes a first embodiment of an adapter locking clip in accordance with the invention.
Figure 2:
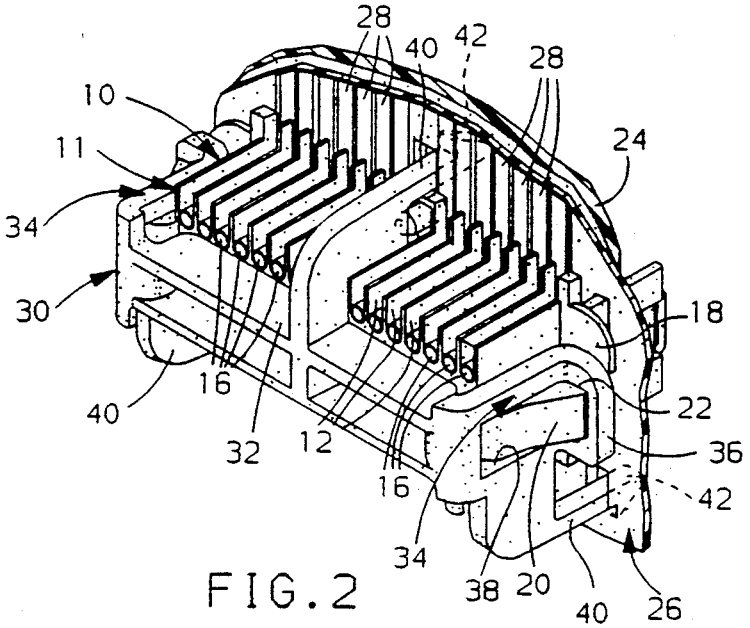
FIG. 2 is a perspective view showing the electrical connector system of FIG. 1 in the assembled position.

Referring now to the drawing, FIGS. 1 and 2 show an electrical connector system for attaching a wiring harness to a flexible printed circuit by an already known electrical connector 10 of the pull-to-seat type at the end of the wiring harness. This known electrical connector 10 comprises a molded thermoplastic connector body 11 that has two rows of terminal cavities 12. The terminal cavities hold terminals 14 of the type which are shown in the aforesaid U.S. Pat. No. 4,474,420 granted to Charles K. Nestor. The terminals 14 are attached to the ends of electric cables 16 of the wiring harness in a well know manner.

The electrical connector body 11 of this known electrical connector 10 includes panel mounting means of the pull-to-seat type by means of which the electrical connector 10 can be firmly mounted on a support panel by fishing the electrical connector 10 through a slot of the support panel and pulling the electrical connector part way back into the slot. More specifically this pull-to seal panel mounting means takes the form of a flange 18 for engaging the back side of the support panel and a pair of flexible latch arms 20 that have intermediate lock shoulders 22 for engaging the front side of the panel. The flange 18 is interrupted at each of terminal cavities 12 to facilitate loading the terminals 14 into the terminal cavities 12. The flange 18 is also interrupted in the area of the latch arms 20 to facilitate molding of the latch arms 20 and to permit the latch arms 20 to extend beyond the flange 18.

The pull-to-seat electrical connector 10 is normally mounted to a support panel, such as the panel 24 supporting a flexible printed circuit 26, by initially mounting the electrical connector 10 on an auxiliary panel (not shown) to form a sub-assembly which is then plugged into the panel 24. The auxiliary panel is then fastened to the panel 24 so that the terminals 14 of the electrical connector 10 engage conductor strips 28 of the flexible printed circuit 26 to electrically connect the electric cables 16 of the wiring harness to the flexible printed circuit 26.

The pull-to-seat electrical connector 10 is initially mounted on this auxiliary panel (not shown) by fishing the electrical connector 10 through a slot of the auxiliary panel and then pulling the electrical connector 10 part way back through the slot, cable end first, until the lock shoulders 22 of the flexible latch arms 20 snap through the slot whereupon the auxiliary panel is held firmly between the lock shoulders 22 of the flexible lock arms 20 and the flange 18.

However, the electrical connector 10 further includes a molded thermoplastic adapter locking clip 30 in accordance with this invention in order to eliminate the need for initially mounting the electrical connector 10 on such an auxiliary panel. This adapter locking clip 30 converts the panel mounting means of the electrical connector 10 from a pull-to-seat type to a push-to-seat or plug-in type so that the electrical connector 10 can be plugged directly into the panel 24 thereby eliminating the need for the tedious pull-to-seat assembly of the electrical connector 10 to the auxiliary panel.

The adapter locking clip 30 comprises a base 32 having a clasp 34 at each end that embraces the respective flexible latch arms 20 of the electrical connector 10 and fastens the adapter locking clip 30 to the electrical connector 10 as shown in FIG. 2.

The clasps 34 are L-shaped in the longitudinal direction to form ends that project outwardly of the base 32 to provide lock bars 36. The clasps 34 also have longitudinal slots 38 that receive the respective flexible latch arms 20 of the electrical connector 10 when the adapter locking clip 30 is pushed onto the cable end of the connector body 11. During assembly the lock shoulders 22 snap under the lock bars 36 so that the lock bars 36 are positioned between the lock shoulders 22 and the flange 18 of the connector body 11 as shown in FIG. 2. It should be noted that the base 32 has a short height so that it fits between the rows of electrical cables 16 when the adapter locking clip is pushed onto the cable end of the connector body 11.

The adapter locking clip 30 also includes a plurality of longitudinal appendages 40 with flexible end portions that have barbs 42 disposed forwardly of the lock bars 36 and of the flange 18 of the electrical connector 10 when the adapter locking clip 30 is fastened to the electrical connector 10. Thus, the barbs 42 engage the back side of the support panel 24 when the electrical connector 10 is plugged into the support panel 24 as shown in FIG. 2. The longitudinal appendages 40 are in a triangular array with an appendage integrally attached to an upward extension at the mid portion of the base 32 and appendages integrally attached to downward extensions of the respective clasps 34.

The adapter locking clip 30 may include an assembly guide in the form of a longitudinal finger 44 that extends forwardly of the base 32 beyond the appendages 40. The finger 44 cooperates with a guide hole 46 in the connector body 11 between the rows of terminal cavities 12. The finger 44 and guide hole 46 are offset from the centerline of the connector body 11 to signal the correct orientation of the adapter locking clip 30 during assembly to the connector body 11. The widths of the lock arms 20 and the slots 38 of the clasps 34 are also different on each side to assure that the adapter locking clip 30 is assembled to the connector body 11 in the correct orientation.

Figure 3:
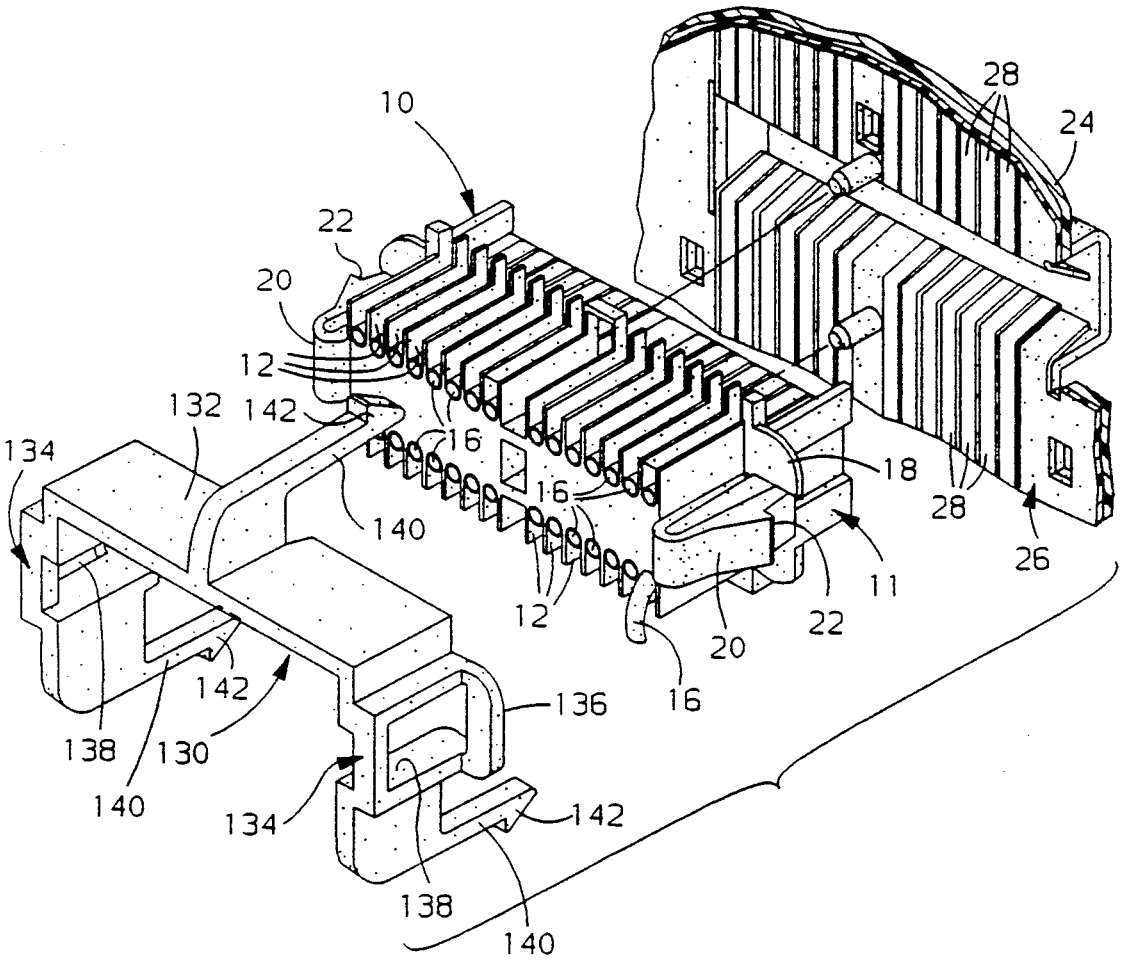
FIG. 3 is an exploded perspective view of an electrical connector system for attaching a wiring harness to a flexible printed circuit that includes a second embodiment of an adapter locking clip in accordance with the invention.

A second embodiment of an adapter locking clip in accordance with the invention is illustrated in FIG. 3. In this second embodiment, the base 132 of the adapter clocking clip 130 is oriented horizontally rather than vertically so that the base 132 is adjacent the top of the electrical connector 10 rather than behind the electrical connector 10 when the adapter locking clip 130 is attached to the electrical connector 10. This embodiment is easier to assemble to the electrical connector 10 because the base 132 does not have to be inserted between the rows of conductor cables 16. In this embodiment the clasps 134 project downwardly from each end of the base 132.

However, the clasps 134 are still L-shaped in the longitudinal direction to form ends that project outwardly of the base 132 and provide lock bars 136. The clasps 134 likewise include longitudinal slots 138 that receive the respective flexible latch arms 20 of the electrical connector 10 when the adapter locking clip 130 is pushed onto the cable end of the connector body 11 so that the lock bars 136 are positioned between the lock shoulders 22 and the flange 18 of the connector body 11.

The adapter locking clip 130 also includes a plurality of longitudinal appendages 140 with flexible end portions that have barbs 142 disposed forwardly of the lock bars 136 and of the flange 18 of the electrical connector 10 when the adapter locking clip 130 is fastened to the electrical connector 10 so that the barbs 142 engage the back side of the support panel 24 when the electrical connector 10 is plugged into the support panel 24. The longitudinal appendages 140 are also in a triangular array with an appendage integrally attached to an upward extension at the mid portion of the base 132 and appendages integrally attached to downward extensions of the respective clasps 140.

I wish it to be understood that I do not desire to be limited to the exact details of construction shown and described, for obvious modifications will occur to a person skilled in the art.

I claim:

1. An adapter locking clip for converting an electrical connector having pull-to-seat panel mounting means to a push-to-seat or plug-in type electrical connector wherein the pull-to-seat panel mounting means includes flexible latch arms adjacent the opposite sides of the electrical connector and a flange, the flexible latch arms having lock shoulders which cooperate with the flange for engaging opposite sides of a support panel, the adapter locking clip comprising;

a base having a clasp at each end for embracing the respective flexible latch arms of the electrical connector and fastening the locking clip to the electrical connector including lock bars disposed and configured to fit between the respective lock shoulders of the flexible latch arms and the flange of the electrical connector, and a plurality of longitudinal appendages that have barbs disposed forwardly of the lock bars and the flange of the electrical connector when the adapter locking clip is fastened to the electrical connector so that the barbs engage the back side of a support panel when the electrical connector is plugged into the support panel.

2. The adapter locking clip as defined in claim 1 wherein the clasps at each end of the base have longitudinal slots for receiving the respective flexible latch arms of the electrical connector.

3. The adapter locking clip as defined in claim 1 wherein the clasps at each end of the base are L-shaped in the longitudinal direction and have ends that project outwardly of the base to provide the lock bars that fit between the lock shoulders of the flexible latch arms and the flange of the connector body when the adapter locking clip is fastened to the electrical connector.

4. The adapter locking clip as defined in claim 2 wherein the clasps at each end of the base are L-shaped in the longitudinal direction and have ends that project outwardly of the base to provide the lock members that fit between the lock shoulders of the flexible latch arms and the flange of the connector body when the adapter locking clip is fastened to the electrical connector.

5. The adapter locking clip as defined in claim 1 wherein the plurality of longitudinal appendages include an appendage integrally attached to the base and an appendage integrally attached to each clasp.

6. The adapter locking clip as defined in claim 1 wherein the plurality of longitudinal appendages include a triangular array of an appendage integrally attached to an upper extension at a mid portion of the base and an appendage integrally attached to a downward extension of each clasp.

7. The adapter locking clip as defined in claim 1 wherein the clasps project forwardly from each end of the base so that the base is behind the electrical connector when the adapter locking clip is fastened to the electrical connector.

8. The adapter locking clip as defined in claim 1 wherein the clasps project downwardly from each end of the base so that the base is adjacent the top of the electrical connector when the adapter locking clip is fastened to the electrical connector.

9. An adapter locking clip for converting an electrical connector having pull-to-seat panel mounting means to a push-to-seat or plug-in type electrical connector wherein the pull-to-seat panel mounting means includes flexible latch arms adjacent the opposite sides of the electrical connector and a flange, the flexible latch arms having lock shoulders which cooperate with the flange for engaging opposite sides of a support panel, the adapter locking clip comprising;

a base having a clasp at each end for embracing the respective flexible latch arms of the electrical connector and fastening the locking clip to the electrical connector, the clasps as each end of the base having longitudinal slots for receiving the respective flexible latch arms of the electrical connector and being L-shaped in the longitudinal direction with ends that project outwardly of the base to provide lock bars that fit between the lock shoulders of the flexible latch arms and the flange of the connector body when the adapter locking clip is fastened to the electrical connector, and a plurality of longitudinal appendages that have barbs disposed forwardly of the lock bars and the flange of the electrical connector when the adapter locking clip is fastened to the electrical connector so that the barbs engage the back side of a support panel when the electrical connector is plugged into the support panel.

10. The adapter locking clip as defined in claim 9 wherein the plurality of longitudinal appendages include an appendage integrally attached to the base and an appendage integrally attached to each clasp.

11. The adapter locking clip as defined in claim 9 wherein the plurality of longitudinal appendages include a triangular array of an appendage integrally attached to an upper extension at a mid portion of the base and an appendage integrally attached to a downward extension of each clasp.

12. The adapter locking clip as defined in claim 9 wherein the clasps project forwardly from each end of the base so that the base is behind the electrical connector when the adapter locking clip is fastened to the electrical connector.

13. The adapter locking clip as defined in claim 9 wherein the clasps project downwardly from each end of the base so that the base is adjacent the top of the electrical connector when the adapter locking clip is fastened to the electrical connector.

* * * * *